US009683764B2

(12) United States Patent
Moreau et al.

(10) Patent No.: US 9,683,764 B2
(45) Date of Patent: Jun. 20, 2017

(54) MULTI-LAYER EVAPORATOR FOR MOTOR VEHICLE AIR-CONDITIONING CIRCUIT

(75) Inventors: Sylvain Moreau, Spay (FR); Francois Busson, Saint Gervais en Belin (FR); Regine Haller, Boissy Sans Avoir (FR); Mohamed Yahia, Paris (FR); Bertrand Nicolas, Paris (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 383 days.

(21) Appl. No.: 14/344,918

(22) PCT Filed: Sep. 13, 2012

(86) PCT No.: PCT/EP2012/067969

§ 371 (c)(1),
(2), (4) Date: Aug. 13, 2014

(87) PCT Pub. No.: WO2013/037898

PCT Pub. Date: Mar. 21, 2013

(65) Prior Publication Data

US 2014/0373570 A1 Dec. 25, 2014

(30) Foreign Application Priority Data

Sep. 16, 2011 (FR) ..... 11 58270

(51) Int. Cl.
*F25B 39/02* (2006.01)
*F28F 1/10* (2006.01)
(Continued)

(52) U.S. Cl.
CPC ..... *F25B 39/022* (2013.01); *F25B 39/02* (2013.01); *F28D 1/05391* (2013.01);
(Continued)

(58) Field of Classification Search
CPC ..... F25B 39/022; F25B 39/02; F25B 39/028; F25B 2339/02; F28F 9/026; F28F 27/02; F28D 1/05391; F28D 2021/0085
(Continued)

(56) References Cited

U.S. PATENT DOCUMENTS 6,116,048 A * 9/2000 Hebert ..... F24F 1/0059 62/524
2003/0209344 A1* 11/2003 Fang et al. ..... 165/140
(Continued)

FOREIGN PATENT DOCUMENTS

DE 102008018644 A1 10/2009
FR 2920045 A1 2/2009
(Continued)

OTHER PUBLICATIONS

Machine translation of WO 2009/022020.*
(Continued)

*Primary Examiner* — Ryan J Walters
*Assistant Examiner* — Joseph Trpisovsky
(74) *Attorney, Agent, or Firm* — Howard & Howard Attorneys PLLC

(57) ABSTRACT

Evaporator, notably for motor vehicle air-conditioning circuit. According to the invention, the evaporator (1), which comprises three layers—upstream (2), intermediate (3) and downstream (4)—through which there flows a coolant that enters the evaporator (1) via the intermediate layer (3) and leaves the evaporator via the upstream layer (2) to cool an air flow (A) passing in succession across said upstream (2), intermediate (3) and downstream (4) layers, comprises means (5E) for inducing a pressure drop between the outlet of the intermediate layer (3) and the inlet of the downstream layer (4).

15 Claims, 3 Drawing Sheets

(51) Int. Cl.

| | |
|---|---|
| ***F28F 9/02*** | (2006.01) |
| ***F28D 7/06*** | (2006.01) |
| ***F28F 27/02*** | (2006.01) |
| ***F28D 1/053*** | (2006.01) |
| *F28D 21/00* | (2006.01) |

(52) U.S. Cl.
CPC ..... *F28F 9/026* (2013.01); *F28F 27/02* (2013.01); *F25B 2339/02* (2013.01); *F28D 2021/0085* (2013.01)

(58) Field of Classification Search
USPC ..... 62/525, 524, 515, 526; 165/172–176, 165/166, 148
See application file for complete search history.

(56) References Cited

U.S. PATENT DOCUMENTS

| | | | | |
|---|---|---|---|---|
| 2004/0055327 | A1 | 3/2004 | Ohta et al. | |
| 2004/0216863 | A1* | 11/2004 | Hu | 165/110 |
| 2006/0137388 | A1* | 6/2006 | Kakehashi et al. | 62/513 |
| 2007/0169511 | A1* | 7/2007 | Ishizaka et al. | 62/500 |
| 2007/0256823 | A1 | 11/2007 | Molt et al. | |

FOREIGN PATENT DOCUMENTS

| | | | | | |
|---|---|---|---|---|---|
| JP | 06194001 | A | * | 7/1994 | F28D 1/0341 |
| WO | WO 2005066565 | A1 | | 7/2005 | |
| WO | WO 2009022020 | A1 | | 2/2009 | |

OTHER PUBLICATIONS

English language abstract and machine-assisted English translation for DE 102008018644 extracted from espacenet.com database on Jul. 1, 2014, 10 pages.
English language abstract and machine-assisted English translation for FR 2920045 extracted from espacenet.com database on Jul. 1, 2014, 13 pages.
English language abstract for WO 2005066565 extracted from espacenet.com database on Jul. 1, 2014, 2 pages.
English language abstract and machine-assisted English translation for WO 2009022020 extracted from espacenet.com database on Jul. 1, 2014, 13 pages.
International Search Report for PCT/EP2012/067969 dated Nov. 6 2012, 7 pages.

* cited by examiner

MULTI-LAYER EVAPORATOR FOR MOTOR VEHICLE AIR-CONDITIONING CIRCUIT

RELATED APPLICATIONS

This application is the National Stage of International Patent Application No. PCT/EP2012/067969, filed on Sep. 13, 2012 which claims priority to and all the advantages of French Patent Application No. FR 11/58270, filed on Sep. 16, 2011, the contents of which are incorporated herein by reference.

The present invention relates to an evaporator, notably for a motor vehicle air-conditioning circuit.

In particular, the invention relates to the evaporators which are formed of several layers arranged in parallel planes.

Such a multi-layer evaporator which comprises:

three layers adjacent in pairs—respectively referred to as the upstream, the intermediate and the downstream layers because of how they are arranged with respect to the direction in which the airflow flows—which extend in parallel planes, each layer being formed of a plurality of parallel canals through which there passes a refrigerant that is to be evaporated in order to cool a flow of air passing in succession across said upstream, intermediate and downstream layers in an incident direction directed substantially orthogonally to the planes of the layers. The intermediate and downstream layers form an evaporator core. The upstream layer is itself able to superheat the refrigerant after it has passed through the evaporator core; and fluid distributing means arranged at the two ends of the layers to distribute and collect the refrigerant into and from the various canals of each of the layers, is already known from patent application FR-2920045 (of which the applicant is the proprietor).

The canals are produced either from individual heat exchange plates joined together in such a way as to define a desired circulation of the fluid or from individual tubes joined at their two ends by header tanks the internal structure of which determines the various circulation passes of the refrigerant, for example using intermediate partitions provided in these tanks and isolating subsets of canals of a layer. A "circulation pass" means the passage of the refrigerant through a canal of a layer.

The distribution means (configuration of the plates or internal partitioning of the header tank) may be designed to allow circulation in several passes with reversal of direction from one pass to the next.

The incident flow of air that is to be cooled, by passing through the gaps between the canals of the layers, gives up heat to the refrigerant which passes from the liquid state to the gaseous state. The flow of air thus cooled can be used for air-conditioning the interior of a motor vehicle.

Moreover, it is known that, in order to optimize the thermal efficiency and the cooling performance of such evaporators it is essential to maximize the temperature difference between the incident air and the cooled air leaving the evaporator while at the same time maintaining good uniformity of temperature across all the regions (right/left, top/bottom) thereof. That entails good control over the evaporation process, notably from the standpoint of the distribution of the flow of refrigerant through the canals and the standpoint of pressure drops within the various regions of the evaporator. Good distribution will notably be assured if the difference in pressure drops between the inlet and the outlet of the evaporator, when passing through each canal, is kept at a relatively low level.

It is an object of the present invention to improve the thermal efficiency and the cooling performance of the aforementioned evaporators by maximizing the temperature difference between the incident air and the cooled outgoing air.

To this end, according to the invention, the evaporator, notably for a motor vehicle air conditioning circuit, comprising at least three layers, these respectively being an upstream, an intermediate and a downstream layer, extending in parallel planes, each layer being formed of a plurality of canals through which a refrigerant that is to be evaporated in order to cool an airflow passing in succession across said upstream, intermediate and downstream layers is intended to circulate in a predefined circulation path, is notable:

in that the refrigerant enters the evaporator via the intermediate layer and leaves the evaporator via the upstream layer having passed through the downstream layer; and in that the evaporator comprises means for introducing a pressure drop between the outlet of the intermediate layer and the inlet of the downstream layer.

Thus, by virtue of the invention, the refrigerant is expanded as a result of the localized additional pressure drop between the intermediate layer and the downstream layer, making it possible to lower the temperature of the refrigerant circulating through the downstream layer. The variation in temperature between the incident air and the air leaving the evaporator is therefore increased in comparison with the known evaporators mentioned hereinabove.

It is to the Applicant Company's credit that they have therefore deliberately introduced, at a predefined and localized point, a pressure drop which is uniform across all of the canals without degrading the performance of the evaporator. In so doing, the Applicant Company has gone against the preconceptions of the person skilled in the art who, in order to optimize cooling performance, attempt to reduce or eliminate as far as possible pressure drops within evaporators.

Advantageously, the pressure drop obtained by the means of introducing a pressure drop is comprised between 0.5 bar and 1 bar. The difference in pressure of the refrigerant between the inlet and the outlet of the means of introducing a pressure drop is negative, making it possible to achieve the desired expansion of the refrigerant which is liable to cause this refrigerant to cool down.

For preference, the means of introducing a pressure drop are formed by at least one end canal of the downstream layer, through which canal the refrigerant passes after it has passed through the intermediate layer. In this case, the means of introducing a pressure drop are incorporated into the downstream layer.

In one embodiment according to the present invention, the canals of each of the layers are formed of individual tubes connected at their two ends by a first and a second header tank, comprising means for distributing the refrigerant in said layers and for ensuring the predefined circulation of refrigerant through the various tubes; and said header tanks are configured to cause all of the refrigerant, having passed through the intermediate layer, to circulate through the end canal of the downstream layer, the one that introduces the pressure drop, so that this canal delivers the refrigerant to the said downstream layer.

As an alternative, the means for introducing a pressure drop may take the form of at least one external tube, of predetermined cross section, which connects the intermediate layer to the downstream layer in such a way that the refrigerant, having passed through the intermediate layer, is delivered to the downstream layer. The cross section of the external tube is advantageously chosen in such a way as to obtain a pressure drop comprised between 0.5 bar and 1 bar.

Moreover, the evaporator refrigerant inlet and outlet may occur on one and the same lateral face of the evaporator.

Furthermore, the evaporator may comprise a connection, incorporated or added in, allowing refrigerant to be transferred from the downstream layer to the upstream layer, which is the first to have the air that is to be cooled passing through it.

The present invention also relates to a tank of a heating, ventilation and/or air-conditioning installation, notably for a motor vehicle interior, comprising an evaporator as mentioned hereinabove.

In addition, as shown in FIG. 4, the invention further relates to an air-conditioning circuit through which there circulates a refrigerant, comprising at least a compressor 50, an external heat exchanger 52, an evaporator 1 of the type described hereinabove and, optionally, an internal heat exchanger 54.

The figures of the attached drawing will make it easy to understand how the invention may be embodied. In these figures, identical references denote elements which are similar.

Figure 1:
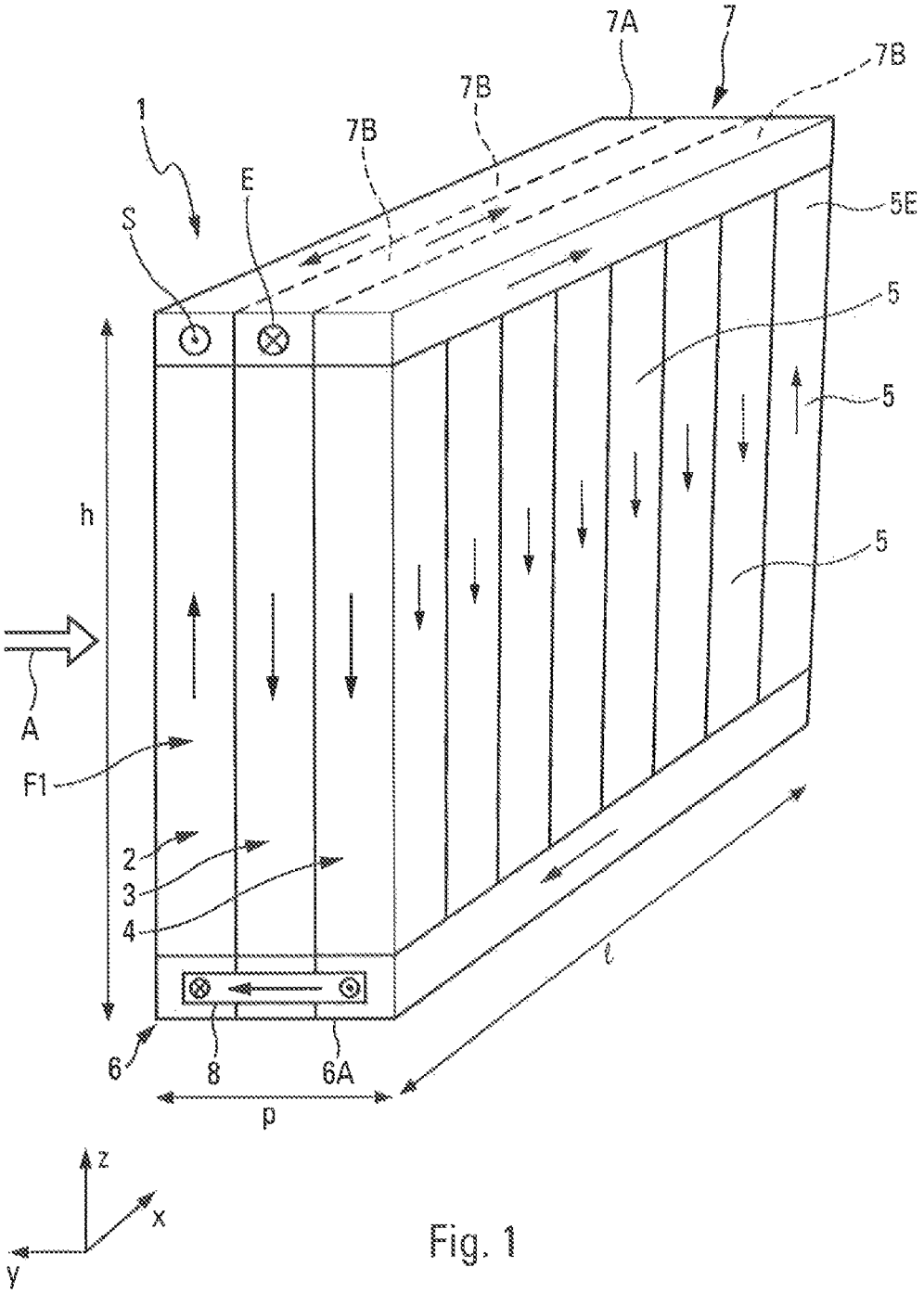
FIG. 1 is a schematic perspective view of an evaporator according to the present invention.
Figure 2:
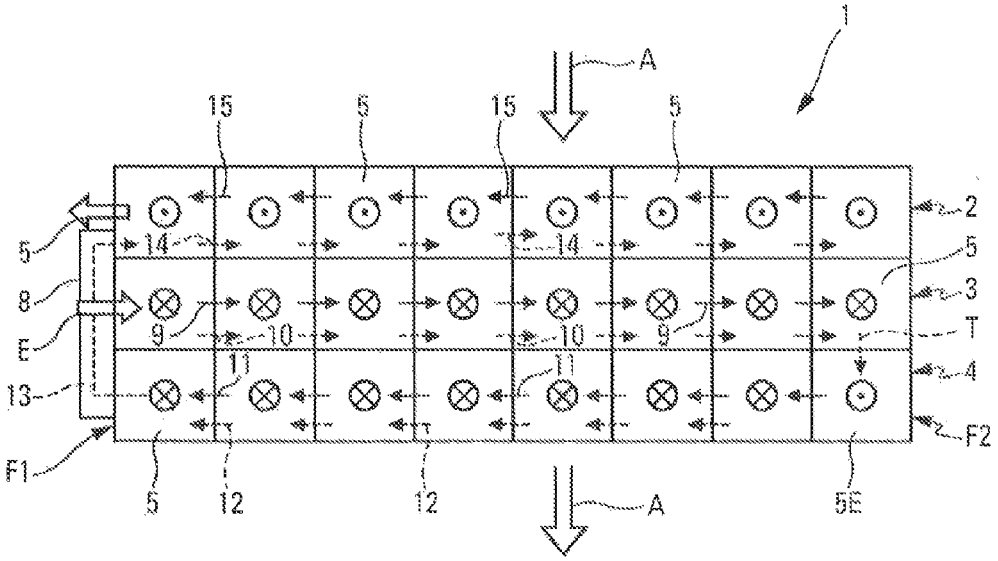
FIG. 2 is a schematic plan view of the evaporator of FIG. 1, bearing marking symbolizing the circulation of refrigerant through the three layers of the evaporator.

FIGS. 1 and 2 very schematically depict one embodiment of an evaporator 1 according to the present invention.

In a particular (but nonlimiting) application of the present invention, the evaporator 1 is incorporated into a motor vehicle air-conditioning circuit (not depicted in the figures) operating at least in a heat pump, the evaporator being positioned in a vehicle heating, ventilation and/or air-conditioning housing (not depicted).

As these figures show, the evaporator 1, which extends over a width 1 in a longitudinal direction x, over a depth p in a transverse direction y and over a height h in a vertical direction z comprises three layers, these respectively being an upstream 2, an intermediate 3 and a downstream 4 layer, which extend in planes parallel to the plane (x, z) and through which a refrigerant that is to be evaporated in order to cool a stream of air (symbolized by the arrow A) passing in succession through the upstream 2, intermediate 3 and downstream 4 layers is intended to circulate with a predefined circulation path (detailed hereinafter). In other words, the upstream, intermediate and downstream layers are arranged one behind the next in the direction y.

Each layer 2, 3, 4 is formed of a plurality of longitudinal tubes 5—extending in the vertical direction z and evenly distributed in the longitudinal direction y—through which the refrigerant can pass.

According to the invention, the refrigerant enters the evaporator 1 at a lateral inlet/output face F1, via the intermediate layer 3 and leaves this evaporator via the upstream layer 2 having passed through the downstream layer 4. The upstream layer 2 is a layer that heats up the refrigerant after it has evaporated during its passage through the intermediate 3 and downstream 4 layers.

The evaporator 1 also comprises two header tanks, respectively a lower tank 6 and an upper tank 7—of a shape that is elongate in the longitudinal direction x—into which tanks the tubes 5 of each of said layers 2, 3, 4 opens. The two longitudinal ends of the tubes 5 are therefore housed respectively in the lower header tank 6 and in the upper header tank 7.

The lower 6 and upper 7 header tanks are configured to define a path for the refrigerant through the three layers 2, 3, 4 between a fluid inlet and outlet (which are symbolized by the arrows E and S respectively).

In particular, the lower 6 and upper 7 header tanks may each comprise an end plate (not depicted) and a cover 6A, 7A attached to this plate. The end plate and the cover 6A, 7A of each of the header tanks 6 and 7 have a rectangular shape and extend lengthwise in the longitudinal direction x and widthwise in the transverse direction y.

Each end plate, which is made of a metallic material, comprises a planar contact face—on which the corresponding cover 6A, 7A is mounted—which is pierced with a plurality of through-holes distributed in a first and a second row which are parallel and run in the longitudinal direction x. The cross section of the holes corresponds to the external cross section of the tubes 5 so that the longitudinal end of each of the tubes 5 can, at least in part, pass through the corresponding hole in the end plate.

Furthermore, the cover 7A of the upper header tank 7 (referred to as the upper cover) has three longitudinal recesses 7B—parallel to one another—which run in the longitudinal direction x. The three longitudinal recesses 7B may have a cross section of semicircular shape and be produced by pressing a sheet of metal which, once pressed, forms the cover 7A of the upper header tank 7.

The three recesses 7B of the upper cover 7A are separated from one another by longitudinal dividing partitions (not depicted). Thus, when the upper cover 7A is secured to the corresponding end plate, the three longitudinal recesses 7B are independent of one another and define three, upstream, intermediate and downstream, upper compartments into which the upper longitudinal ends of the tubes 5 of the upstream 2, intermediate 3 and downstream 4 layers respectively open. The upper compartments of the upper header tank 7 have no fluidic communication with one another.

One of the longitudinal ends of the intermediate upper compartment forms the inlet E for coolant entering the evaporator 1, whereas one of the longitudinal ends of the upstream upper compartment defines the outlet S for coolant leaving the evaporator 1.

Similarly, the cover 6A of the lower header tank 6 (referred to as lower cover) comprises three longitudinal recesses parallel to one another and running in the longitudinal direction x.

The three recesses of the lower cover 6A are separated from one another by longitudinal dividing partitions. Thus, when the lower cover 6A is secured to the corresponding end plate, the three longitudinal recesses define three, upstream, intermediate and downstream, lower compartments into which the lower longitudinal ends of the tubes 5 of the upstream 2, intermediate 3 and downstream 4 layers respectively open.

There is no communication between the upstream and intermediate lower compartments. By contrast, the intermediate and downstream lower compartments are placed in communication with one another at their longitudinal ends positioned near the lateral face F2 of the evaporator 1 which is the opposite face to the inlet/outlet face F1.

Furthermore, the upstream and downstream lower compartments communicate with one another via a connection 8, at their longitudinal end situated in the inlet/outlet lateral face F1.

Moreover, as FIGS. 1 and 2 show, the evaporator 1 according to the invention comprises means for introducing a pressure drop—comprised between 0.5 bar and 1 bar—between the outlet of the intermediate layer 3 and the inlet of the downstream layer 4.

In the embodiment of FIGS. 1 and 2, the means for introducing a pressure drop are formed by a tube 5E positioned at the longitudinal end of the downstream layer 4—near the face F2—and via which the refrigerant passes after it has passed through the intermediate layer 3.

It should be noted that, in an alternative form (not depicted), the means for introducing a pressure drop may be formed of at least two adjacent end tubes of the downstream layer 4. In another alternative form (likewise not depicted), the means for introducing a pressure drop could be formed by one or more external tubes of small cross section that connect the intermediate layer to the downstream layer in such a way that the refrigerant, having passed through the intermediate layer, is delivered to the downstream layer.

By convention, in FIGS. 1 and 2, the circled dot and the circled cross respectively depict the front end and the rear end of an arrow indicating the flow of refrigerant through the tubes 5. In other words, in FIG. 2, a circled dot (and respectively a circled cross) indicates a circulation of fluid from the bottom to the top (or respectively from the top to the bottom).

Figure 3:
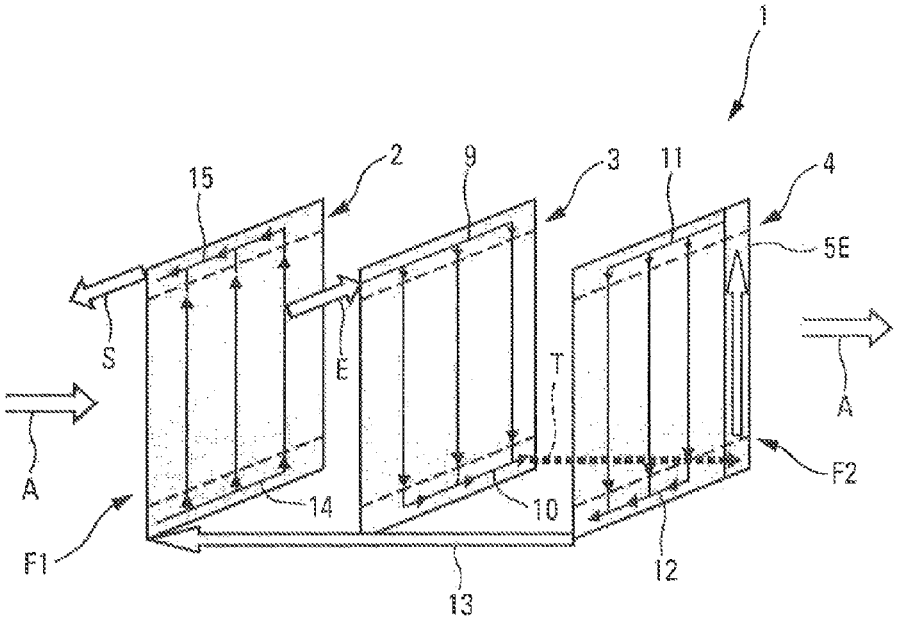
FIG. 3 is a schematic illustration of how the refrigerant circulates through the three layers of the evaporator of FIGS. 1 and 2, which layers are depicted in an exploded perspective view.
Figure 4:
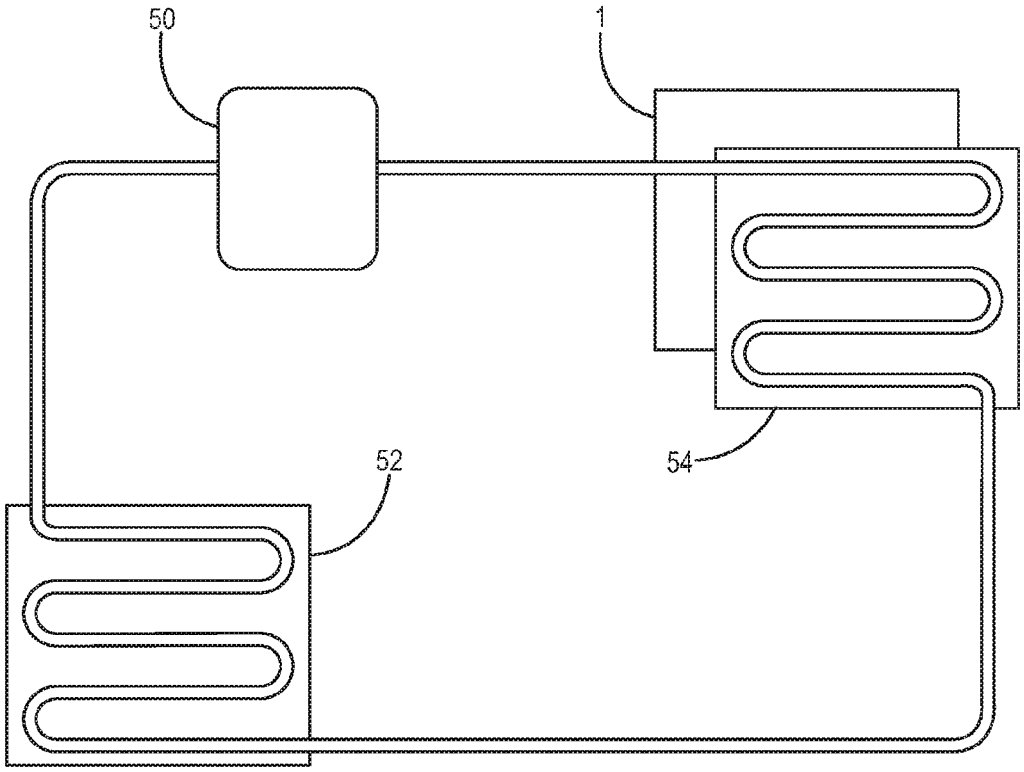
FIG. 4 is a schematic plan view of an air conditioning circuit including the evaporator of FIGS. 1-3.

As FIGS. 1 to 3 show, the refrigerant, arriving via the inlet E of the upper header tank 7, is directed, along the longitudinal axis x, via the upper intermediate compartment to each of the tubes 5 of the intermediate layer 3 so that it can pass through them from top to bottom (the arrows 9 drawn in solid line indicate the distribution of refrigerant at the inlet to the tubes 5, by the upper intermediate compartment).

Having passed through the tubes 5 of the intermediate layer 3, the refrigerant reaches the lower intermediate compartment which directs it towards the longitudinal end of the intermediate layer 3 adjacent to the face F2 (the arrows 10 in broken line indicate the circulation of refrigerant in the lower intermediate compartment).

In other words, the refrigerant circulates in the same direction (from left to right when studying FIG. 2) in the lower and upper intermediate compartments, as indicated by arrows 9 and 10 in FIG. 2.

Having passed through the lower intermediate compartment, the refrigerant is conveyed, via the fluidic communication there is between the intermediate and downstream lower compartments (see arrow T), to the inlet of the end tube 5E of the downstream layer 4 which tube is devoted to introducing the pressure drop, to then pass it through it from the bottom to the top and emerge in the downstream upper compartment of the upper header tank 7 (see FIG. 2). The refrigerant is therefore distributed, by means of the downstream upper compartment, to the various longitudinal tubes 5 (such a circulation of fluid is symbolized by the arrows 11 drawn in solid line) through which it then passes from the top to the bottom, as shown by FIGS. 1 to 3. There is therefore a reversal in the direction of circulation between the end tube 5E and the other tubes 5 of the downstream layer 4. The refrigerant leaving the tubes 5 at their lower longitudinal end is then guided, via the downstream lower compartment, to the inlet of the connection 8 (see arrows 12 in broken line) providing the connection between the downstream layer 4 and the upstream layer 2—through which connection it passes (arrow 13) to arrive in the upstream lower compartment into which the tubes 5 of the upstream layer 2 open.

The upstream lower compartment then distributes the refrigerant to the various longitudinal tubes 5 of the upstream layer 2 (see arrows 14 in broken line) through which it circulates from bottom to top to arrive in the upstream upper compartment. This compartment then guides the refrigerant, across the entire width 1, toward the refrigerant outlet S from the evaporator 1 (see arrows 15 in solid line) through which outlet it passes in order to leave.

FIG. 3 depicts, very schematically and in perspective, the circulation of refrigerant through the various layers 2, 3, 4 of the evaporator 1.

In the embodiment of FIGS. 1 to 3, the evaporator 1 is produced from tubes 5 but as an alternative it could equally well use plate-based technology. The use of tubes 5 and associated header tanks 6 and 7, in the way described hereinabove, does however allow the refrigerant to be homogenized before it is transferred from one layer to another, the upper and lower compartments of the header tanks 6 and 7 acting as mixing chambers. This notably allows an improvement in heat exchange.

Moreover, the evaporator 1 also comprises corrugated spacers (not depicted in the figures) formed of a plurality of heat exchange fins. Each corrugated spacer is positioned between two adjacent tubes 5 of the upstream 2, intermediate 3 and downstream 4 layers. Contact is maintained between the corrugated spacer and the corresponding tubes 5 flanking it, to facilitate heat exchange.

By virtue of the invention, the refrigerant is made to expand as a result of the localized additional pressure drop between the intermediate layer 3 and the downstream layer 4. In so doing, the temperature of the refrigerant circulating through the downstream layer 4, which layer is desired to be the coldest of the evaporator 1 because this is the layer via which the flow of air leaves the evaporator, is lowered. The variation in temperature between the incident air and the air leaving the evaporator 1 is therefore increased in comparison with the known evaporators mentioned hereinabove.

Advantageously, the pressure drop obtained as a result of the means 5E of introducing a pressure drop is comprised between 0.5 bar and 1 bar. The difference in pressure of the refrigerant between the inlet and the outlet of the means of introducing a pressure drop is negative, making it possible to cause the refrigerant to expand causing it and therefore the downstream layer 4 to become cooled.

Of course the present invention is not in any way restricted to the embodiment described hereinabove. In particular, it goes without saying that:

- the evaporator according to the invention could comprise more than three layers;
- the refrigerant inlet and outlet could be situated on opposite lateral faces;
- etc.

The invention claimed is:

1. An evaporator (1) for a motor vehicle air conditioning circuit the evaporator (1) comprising at least three layers (2, 3, 4), respectively being an upstream, an intermediate and a downstream layer, extending in parallel planes, each layer (2, 3, 4) including a plurality of canals (5) through which a refrigerant, that is to be evaporated in order to cool an airflow (A) passing in succession across the upstream (2), intermediate (3) and downstream (4) layers, is intended to circulate in a predefined circulation pass, wherein:

the refrigerant enters the evaporator (1) at a lateral face (F1) via the intermediate layer (3) and leaves the evaporator (1) via the upstream layer (2) having passed through the downstream layer (4); and the evaporator (1) comprises means (5E) positioned at a longitudinal end of the downstream layer (4) opposite the lateral face (F1) for introducing a pressure drop between an outlet of the intermediate layer (3) and an inlet of the downstream layer (4).

2. The evaporator (1) as claimed in claim 1, wherein the pressure drop obtained by the means (5E) for introducing a pressure drop is between 0.5 bar and 1 bar.

3. The evaporator (1) as claimed in claim 2, wherein the means (5E) for introducing a pressure drop include at least one end canal (5E) of the downstream layer (4), through which the refrigerant passes after the refrigerant has passed through the intermediate layer (3).

4. The evaporator (1) as claimed in claim 2, wherein the means (5E) for introducing a pressure drop include at least one external tube, of predetermined cross section, which connects the intermediate layer (3) to the downstream layer (4) in such a way that the refrigerant, having passed through the intermediate layer (3), is delivered to the downstream layer (4).

5. The evaporator (1) as claimed in claim 2, wherein an evaporator refrigerant inlet (E) and outlet (S) occur on the lateral face (F1) of the evaporator (1).

6. The evaporator (1) as claimed in claim 2, further comprising a connection (8) allowing the refrigerant to be transferred from the downstream layer (4) to the upstream layer (2).

7. The evaporator (1) as claimed in claim 1, wherein the means (5E) for introducing a pressure drop include at least one end canal (5E) of the downstream layer (4), through which the refrigerant passes after the refrigerant has passed through the intermediate layer (3).

8. The evaporator (1) as claimed in claim 7, wherein the canals (5) of each of the layers (2, 3, 4) include individual tubes (5) connected at their two ends by a first and a second header tank (6, 7), comprising means for distributing the refrigerant in the layers (2, 3, 4) and for ensuring the predefined circulation of the refrigerant through the tubes (5); and in which the header tanks (6, 7) are configured to cause all of the refrigerant, having passed through the intermediate layer (3), to circulate through the end canal (5E) of the downstream layer (4), so that the end canal (5E) delivers the refrigerant to the downstream layer (4).

9. The evaporator (1) as claimed in claim 7, wherein an evaporator refrigerant inlet (E) and outlet (S) occur on the lateral face (F1) of the evaporator (1).

10. The evaporator (1) as claimed in claim 1, wherein the means (5E) for introducing a pressure drop include at least one external tube, of predetermined cross section, which connects the intermediate layer (3) to the downstream layer (4) in such a way that the refrigerant, having passed through the intermediate layer (3), is delivered to the downstream layer (4).

11. The evaporator (1) as claimed in claim 10, wherein an evaporator refrigerant inlet (E) and outlet (S) occur on the lateral face (F1) of the evaporator (1).

12. The evaporator (1) as claimed in claim 1, wherein an evaporator refrigerant inlet (E) and outlet (S) occur on said lateral face (F1) of the evaporator (1).

13. The evaporator (1) as claimed in claim 1, further comprising a connection (8) allowing the refrigerant to be transferred from the downstream layer (4) to the upstream layer (2).

14. A tank of a heating, ventilation and/or air-conditioning installation for a motor vehicle interior comprising an evaporator (1) as specified in claim 1.

15. The evaporator (1) as claimed in claim 1, wherein the longitudinal end is near a lateral face (F2) of the evaporator (1), the lateral face (F2) being opposite the lateral face (F1).

* * * * *